US007559300B2

(12) United States Patent
Ruggiero

(10) Patent No.: US 7,559,300 B2
(45) Date of Patent: Jul. 14, 2009

(54) MULTIPLE SLAVE PISTON VALVE ACTUATION SYSTEM

(75) Inventor: Brian Ruggiero, East Granby, CT (US)

(73) Assignee: Jacobs Vehicle Systems, Inc., Bloomfield, CT (US)

( * ) Notice: Subject to any disclaimer, the term of this patent is extended or adjusted under 35 U.S.C. 154(b) by 896 days.

(21) Appl. No.: 10/733,516

(22) Filed: Dec. 12, 2003

(65) Prior Publication Data

US 2005/0126522 A1 Jun. 16, 2005

(51) Int. Cl.
*F01L 9/02* (2006.01)

(52) U.S. Cl. ..... 123/90.12; 123/90.15; 123/90.16; 123/90.17

(58) Field of Classification Search ..... 123/90.12, 123/90.15–90.17, 90.48–90.59
See application file for complete search history.

(56) References Cited

U.S. PATENT DOCUMENTS 4,153,016 A * 5/1979 Hausknecht ..... 123/90.15
5,619,965 A * 4/1997 Cosma et al. ..... 123/322
5,992,376 A * 11/1999 Okada et al. ..... 123/321
6,112,710 A * 9/2000 Egan et al. ..... 123/90.12
6,192,841 B1 * 2/2001 Vorih et al. ..... 123/90.12
6,267,098 B1 * 7/2001 Vanderpoel ..... 123/321
6,321,701 B1 * 11/2001 Vorih et al. ..... 123/90.12
6,386,160 B1 * 5/2002 Meneely et al. ..... 123/90.16
6,412,457 B1 * 7/2002 Vorih et al. ..... 123/90.12
6,474,277 B1 * 11/2002 Vanderpoel et al. ..... 123/90.12

* cited by examiner

*Primary Examiner*—Zelalem Eshete
(74) *Attorney, Agent, or Firm*—David R. Yohannan, Esq.; Kelley Drye & Warren LLP

(57) ABSTRACT

Systems and methods of actuating engine valves using a hydraulic valve actuation system are disclosed. The valve actuation system includes a master piston and two slave pistons slidably disposed in bores provided in a housing. The master piston and two slave pistons are connected together by a hydraulic circuit. Linear motion imparted to the master piston is transferred to the two slave pistons via the hydraulic circuit. In turn, the two slave pistons may actuate one or more engine valves directly or through an intermediate valve bridge. A valve seating device may be provided to assist in seating the engine valves in embodiments where the valve actuation system is adapted to provide variable valve actuation.

1 Claim, 3 Drawing Sheets

MULTIPLE SLAVE PISTON VALVE ACTUATION SYSTEM

FIELD OF THE INVENTION

The present invention relates to systems and methods for actuating valves in an internal combustion engine. More specifically, the present invention relates to systems and methods for hydraulically actuating engine valves.

BACKGROUND

Valve actuation in an internal combustion engine is required in order for the engine to produce positive power and may also be used to provide engine braking. Typically, engine valves may be actuated in response to the rotation of cams. One or more lobes on the cam may displace the engine valve directly, or act on one or more valve train elements, such as a push tube, rocker arm, or other mechanical element connecting the cam to the engine valve. During positive power, intake valves may be opened to admit air and sometimes fuel into a cylinder for combustion. Intake valves may also be opened to permit exhaust gas recirculation (EGR) back into the intake manifold. The exhaust valves may be opened to allow combustion gas to escape from the cylinder during main exhaust or an engine braking event, as well as for EGR.

During engine braking, the exhaust valves may be selectively opened to convert, at least temporarily, an internal combustion engine of compression-ignition type into an air compressor. This air compressor effect may be accomplished by cracking open one or more exhaust valves near piston top dead center position for compression-release type braking, or by maintaining one or more exhaust valves in a cracked open position for much or all of the piston motion for bleeder type braking. In doing so, the engine develops retarding horsepower to help slow the vehicle down. This can provide the operator increased control over the vehicle and substantially reduce wear on the service brakes of the vehicle. A properly designed and adjusted engine brake can develop retarding horsepower that is a substantial portion of the operating horsepower developed by the engine during positive power.

For both positive power and engine braking applications, the engine cylinder intake and exhaust valves may be opened and closed by fixed profile cams in the engine, and more specifically by one or more fixed lobes, which may be an integral part of each of the cams. The use of fixed profile cams can make it more difficult to adjust the timings and/or amounts of engine valve lift needed to optimize valve openings and lift for various engine operating conditions, such as different engine speeds.

One method of adjusting valve timing and lift, given a fixed cam profile, has been to incorporate a "lost motion" device in the valve train linkage between the valve and the cam. Lost motion is the term applied to a class of technical solutions for modifying the valve motion proscribed by a cam profile with a variable length mechanical, hydraulic or other linkage means. Some lost motion systems may be adapted to selectively vary the amount of lost motion on an engine cycle-by-cycle basis and/or to provide more than two levels of valve actuation during engine operation and are referred to as Variable Valve Actuation (VVA) systems.

Some lost motion hydraulic valve actuation systems, whether they are VVA systems or not, may include two hydraulically linked pistons; a master piston and a slave piston. Master and slave pistons may be elongated cylindrical structures that are adapted to slide in and out of bores in a common housing with a hydraulic passage connecting the two bores. A motion used to actuate an engine valve, such as a cam motion, is input to the master piston. The displacement of the master piston by the cam lobe is transferred to the slave piston via the hydraulic linkage connecting the two. When a sufficient amount of the master piston motion is transferred to the slave piston, the engine valve(s) connected to the slave piston may be actuated.

A solenoid valve may be connected to the hydraulic linkage between the master piston and the slave piston. The solenoid valve may be selectively opened to release fluid from the hydraulic linkage, which may prevent the master piston motion from being transferred to the slave piston. One primary distinction between WA and non-VVA lost motion systems may be the speed at which the solenoid valve is capable of release fluid from and refilling the hydraulic linkage between the master and slave pistons. VVA systems often have "high-speed" trigger valves serving in this capacity in order to adjust valve timing on an engine cycle-by-cycle basis.

In some lost motion hydraulic valve actuation systems, the slave piston may be used to open more than one engine valve at a time. For example, many engines employ two or more exhaust valves and two or more intake valves per cylinder. A single slave piston may be used to actuate multiple exhaust or multiple intake valves by acting through a valve bridge. The force required to open engine valves can be substantial, particularly when exhaust valves are opened for compression-release type engine braking. The pressure in the hydraulic linkage between the master and slave pistons that is required to open the engine valves is related to the diameter of the slave piston. The greater the diameter of the slave piston, the lower the hydraulic pressure in hydraulic linkage required to exert a given valve actuation force. Elevated pressures in the hydraulic linkage between the master and slave pistons may mandate thicker and heavier housing walls, place higher stresses on the valve actuation system components, produce greater pressure oscillations in the linkage, and/or may make the system more susceptible to leakage and failures.

Accordingly, there is a need for a hydraulic valve actuation system that can produce lower and/or more stable pressures in the system hydraulic circuit. Theoretically, lower and more stable pressures in the hydraulic circuit could be achieved by increasing the slave piston diameter. There is a limit, however, on the size of the slave piston that may be used in a hydraulic valve actuation system. This limit is imposed by the space constraints of modern engines. Accordingly, there is a need for a hydraulic valve actuation system that produces lower and/or more stable pressures in the system hydraulic circuit while at the same time meeting component size limitations for the engine.

As noted above, many engines employ multiple intake and exhaust valves per engine cylinder. Known hydraulic valve actuation systems utilizing a single slave piston have required the use of a valve bridge to transfer valve actuation motion to multiple engine valves. The need to include a valve bridge may add to the complexity, cost, and space requirements of the valve actuation system. Accordingly, there is a need for a valve actuation system in which slave piston actuation may be transmitted to more than engine valve without the need for a valve bridge.

SUMMARY OF THE INVENTION

Responsive to the foregoing challenges, Applicant has developed an innovative engine valve actuation system comprising: a housing having a first slave piston bore, a second slave piston bore, and a passage adapted to provide hydraulic fluid to the first and second slave piston bores; a first slave piston slidably disposed in the first slave piston bore and a second slave piston slidably disposed in the second slave piston bore; a master piston operatively connected to the housing passage; and a hydraulic fluid control valve operatively connected to the housing passage.

Applicant has further developed an innovative method of actuating two or more engine valves in an internal combustion engine using a system having a master piston hydraulically linked to two or more slave pistons, comprising the steps of: imparting a linear motion to the master piston; imparting a linear motion to the two or more slave pistons responsive to the master piston motion; actuating the two or more engine valves responsive to the motion of the two or more slave pistons; and seating the two or more engine valves by hydraulically opposing the linear motion of the two or more slave pistons as the engine valves approach valve seats.

Applicant has still further developed an innovative engine valve actuation system comprising: a valve train element; a master piston operatively contacting the valve train element; a plurality of slave pistons linked to the master piston by a hydraulic circuit; a variable valve actuation trigger valve operatively connected to the hydraulic circuit; and one or more engine valve elements operatively contacting the plurality of slave pistons.

It is to be understood that both the foregoing general description and the following detailed description are exemplary and explanatory only, and are not restrictive of the invention as claimed.

BRIEF DESCRIPTION OF THE DRAWINGS

In order to assist the understanding of this invention, reference will now be made to the appended drawings, in which like reference characters refer to like elements. The drawings are exemplary only, and should not be construed as limiting the invention.

DETAILED DESCRIPTION OF EMBODIMENTS OF THE INVENTION

Figure 1:
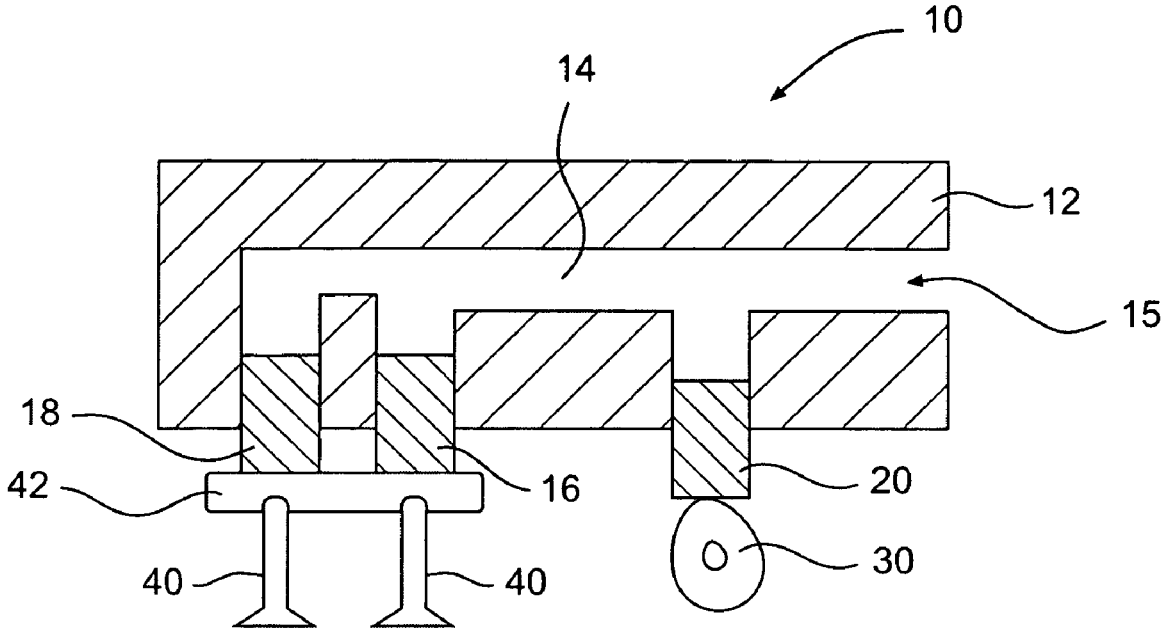
FIG. 1 is a schematic diagram of a valve actuation system constructed in accordance with a first embodiment of the present invention.

Reference will now be made in detail to various embodiments of the present invention, a first example of which is illustrated in FIG. 1. With respect to FIG. 1, a hydraulic valve actuation system 10 is shown. An example of a known hydraulic valve actuation system is disclosed in U.S. Pat. No. 3,220,392 to Cummins, which is hereby incorporated by reference in its entirety. With renewed reference to FIG. 1, the valve actuation system 10 may be operatively connected to a means for imparting motion 30 (such as a cam, rocker arm, push tube or the like) and two or more engine valves 40. The two or more engine valves 40 may be associated with the same engine cylinder and may be the same type of valves. For example, the engine valves 40 may both be exhaust valves associated with a common engine cylinder, or may both be intake valves associated with the engine cylinder.

The valve actuation system 10 may include a housing 12 having one or more internal hydraulic passages 14. First and second slave pistons 16 and 18 may be slidably disposed in first and second slave piston bores, respectively, that are provided in the housing 12. The first and second slave pistons 16 and 18 may be capable of sliding back and forth in their respective bores while maintaining a hydraulic seal with the housing 12. A master piston 20 may be slidably disposed in a master piston bore provided in the housing 12 such that it may slide back and forth in its bore while maintaining a hydraulic seal with the housing 12. It is appreciated that a relatively small amount of hydraulic fluid may escape past the slave and master pistons during normal operation of the system. The slave piston bores and the master piston bore may be capable of hydraulic communication with each other via the hydraulic passage 14. Hydraulic fluid may be provided to, and in some embodiments selectively released from, the hydraulic passage 14 through a port 15. The first and second slave pistons 16 and 18 may make contact with a valve bridge 42 which extends between the engine valves 40. The valve bridge 42 is shown to be a "floating" bridge; however, it is appreciated that the bridge could include a guide structure in alternative embodiments.

The valve actuation system 10 may be used to selectively transfer valve opening motion from the means for imparting motion 30 to the engine valves 40. Use of the valve actuation system 10 may be initialized by providing hydraulic fluid to the system through the port 15 so that the hydraulic passage 14 is filled with low pressure fluid. Filling the hydraulic passage 14 with low pressure fluid may cause the slave pistons 16 and 18 and the master piston 20 to index outward and contact the valve bridge 42 and the means for imparting motion 30, respectively. Any lash space that may exist between the first and second slave pistons 16 and 18 may be taken up or reduced after the hydraulic passage 14 is filled with low pressure fluid. Once the hydraulic passage 14 is filled, the master piston 20 and the first and second slave pistons 16 and 18 may be hydraulically locked. Upward motion imparted to the master piston 20 by the means for imparting motion 30 is transferred through the hydraulic fluid in the passage 14 to the first and second slave pistons 16 and 18. As a result, the first and second slave pistons 16 and 18 may be forced downward against the valve bridge 42 and the engine valves 40 such that the engine valves are opened. The first and second slave pistons 16 and 18 may be shaped and sized such that they move downward together in unison an equal amount due to the motion of the master piston 20.

The relative diameters of the master piston 20 and the first and second slave pistons 16 and 18 may be selected to provide a desired hydraulic ratio that relates linear displacement of the master piston in its bore to corresponding linear displacement of the first and second slave pistons in their respective bores. In a preferred embodiment of the present invention, the system may incorporate an increased slave piston area which can still be feasibly packaged into the overhead. The larger slave piston area may require a larger master piston area and/or an increased amount of lift from the means for imparting motion 30 to maintain the correct valve event lift profile.

Figure 2:
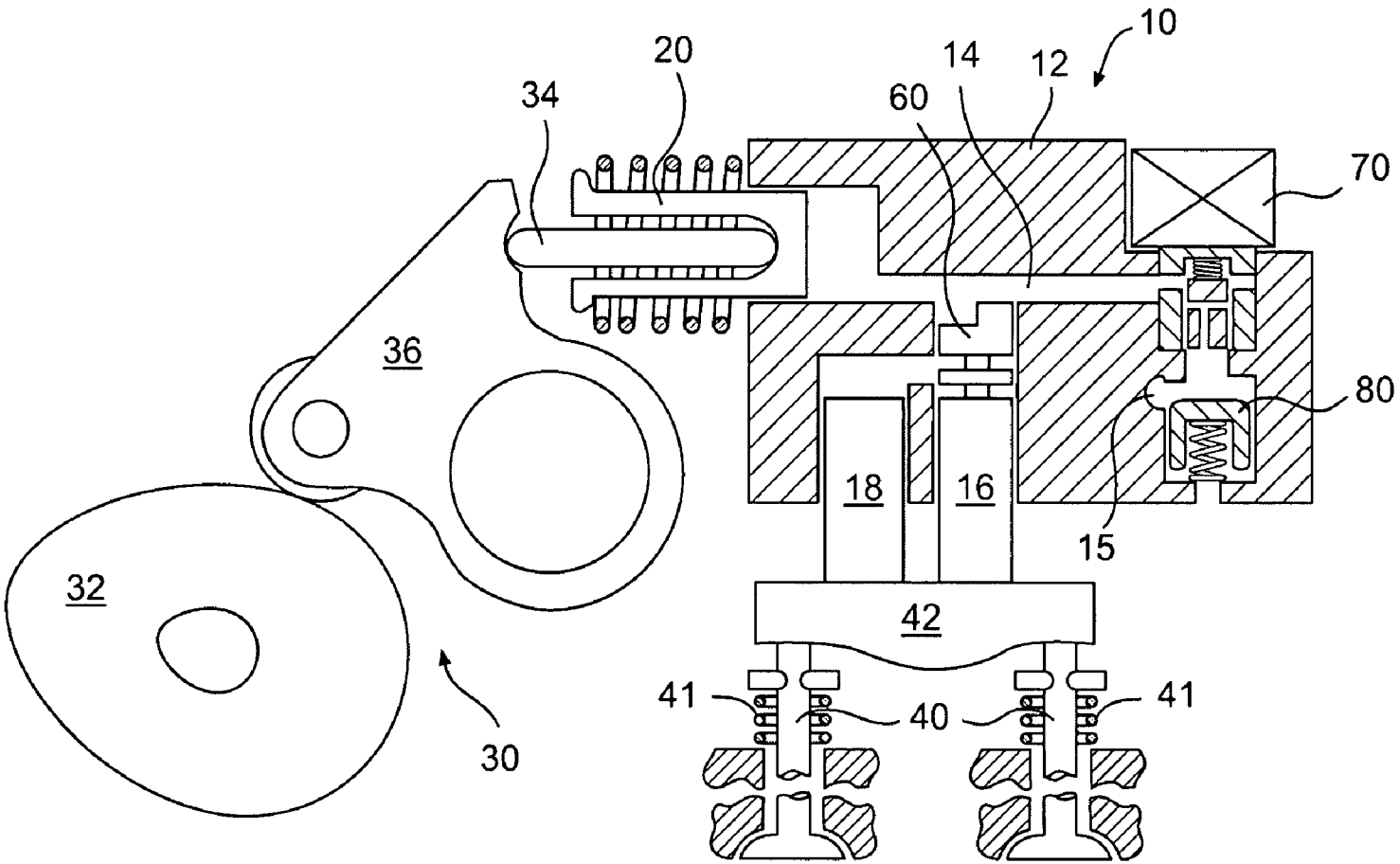
FIG. 2 is a schematic diagram of a variable valve actuation system constructed in accordance with a second embodiment of the present invention.

A second embodiment of the present invention is shown in FIG. 2, in which like reference characters refer to like elements. The valve actuation system 10 shown in FIG. 2 is adapted to provide variable valve actuation, and includes an internal valve seating device 60, a hydraulic fluid control valve (preferably a trigger valve) 70, and an accumulator 80, in addition to those elements described above in connection with FIG. 1. A variable valve actuation system similar to that shown in FIG. 2 (with the exception of the slave piston arrangement) is described in detail in U.S. patent application Publication Ser. No. 10/408,254 filed Apr. 8, 2003, and which is hereby incorporated by reference in its entirety.

With continued reference to FIG. 2, the trigger valve 70 and the accumulator 80 are adapted to selectively release hydraulic fluid from the hydraulic passage 14. By selectively releasing hydraulic fluid from, and/or adding fluid to, the passage 14, the motion of the first and second slave pistons 16 and 18 may be modified from what it would have been had the passage 14 been full. The effect of selectively releasing and adding hydraulic fluid is to cause the engine valves 40 to open later and/or close earlier than when the hydraulic passage 14 is full.

With continued reference to FIG. 2, the means for imparting motion 30 may include a cam 32, a push tube 34, and a rocker arm 36. Rotation of the cam 32 causes the one or more lobes on the cam to displace the rocker arm 36, the push tube 34, and the master piston 20 in turn. Displacement of the master piston 20 causes the first and second slave pistons 16 and 18 to be displaced downward to open the engine valves 40. The elements of the motion imparting means 30 may be designed to provide both a pre-determined opening and closing of the engine valves 40. The pre-determined closing motion may be proscribed by the shape of the lobes on the cam 32. These lobes may be shaped to include a valve seating profile such that the engine valves 40 are seated relatively gently so long as the variable valve actuation system 10 is responding directly to the cam.

When the trigger valve 70 and the accumulator 80 are employed to modify the pre-determined opening and/or closing times, however, the first and second slave pistons may not experience the valve seating profile of the cam 32. In these instances, the valve seating device 60 may assist in seating the engine valves 40. More specifically, if the trigger valve 70 is actuated to allow fluid flow from the one or more passages 14 to the accumulator 80 when the valves 40 are open, the engine valves 40 will advance rapidly toward their respective seats under the influence of the valve springs 41. As the engine valves 40 move towards their seats, the slave pistons 16 and 18 are forced upward and fluid is pushed out of the slave piston bores, into the one or more passages 14, past the trigger valve 70, and into the accumulator 80. In order to reduce the impact of the engine valves 40 with their seats, the valve seating device 60 may throttle (preferably progressively) fluid flow from the slave piston bores to the one or more passages 14.

Examples of valve seating devices that may be used to assist in seating engine valves are described in U.S. Pat. No. 6,510,824 to Vorih, et al., U.S. Pat. No. 6,474,277 to Vanderpoel, et al., U.S. Pat. No. 6,302,370 to Schwoerer, et al., U.S. Patent Application Publication No. 20030098000, Ser. No. 10/251,748 filed Sep. 23, 2002, and U.S. patent application Ser. No. 10/408,254 filed Apr. 8, 2003, each of which are hereby incorporated by reference in their entirety.

The valve seating device 60 may progressively close off the flow of hydraulic fluid past it as the engine valves 40 approach their valve seats. Closing off the flow of hydraulic fluid may be responsive to the first slave piston 16 translating a portion of the valve seating device 60 upward as the first slave piston moves upward. As a result of the valve seating device 60 closing off fluid flow past it, the hydraulic pressure in the slave piston bores increases. The increasing pressure in the slave piston bores opposes the upward motion of the first and second slave pistons 16 and 18, and thus opposes the upward motion of the engine valves, causing the engine valves to seat more gently than they otherwise would.

In the embodiment of the invention shown in FIG. 2 a single valve seating device 60 is provided to service both the first and second slave pistons 16 and 18. The valve seating device 60 is positioned above the first slave piston 16, and it is the first slave piston that contacts the valve seating device. In embodiments where a single valve seating device is activated by one of multiple slave pistons, it may be desirable to make the slave piston that does not activate the valve seating device more massive than the slave piston that does activate the valve seating device. For example, in the embodiment shown in FIG. 2, the first slave piston 16 may include a hollow interior portion, while the second slave piston 18 may be constructed of solid material throughout.

With continued reference to FIG. 2, it may also be desirable to locate the first and second slave pistons 16 and 18 close together. Locating the slave pistons close to each other may reduce the volume of the high-pressure hydraulic fluid circuit required to actuate the engine valves. A relatively smaller high-pressure circuit may improve hydraulic compliance as well as performance of the valve seating device 60. In preferred embodiments of the invention that include a valve bridge 42, the axial center of the slave pistons may be positioned above the engine valve stem or at a location along the valve bridge between the two engine valve stems. In preferred embodiments of the invention that do not include a valve bridge, the axial center of the slave pistons may be positioned directly above the corresponding engine valve stems.

Figure 5:
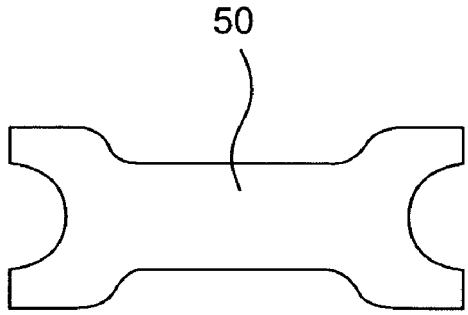
FIG. 5 is a plan view of a yoke used in connection with the valve actuation system shown in FIG. 3.
Figure 3:
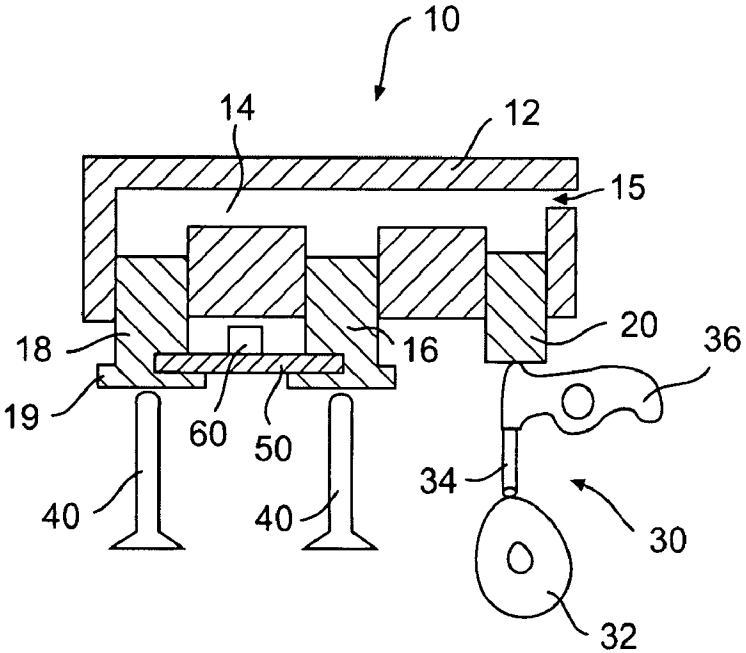
FIG. 3 is a schematic diagram of a valve actuation system constructed in accordance with a third embodiment of the present invention.

A third embodiment of the present invention is shown in FIG. 3, in which like reference characters refer to like elements. The first and second slave pistons 16 and 18 may act directly on each of the individual engine valves 40. The first and second slave pistons 16 and 18 each may also include a circumferential shoulder or flange 19. A yoke 50 may extend between the first and second slave pistons. The yoke 50 (shown in plan view in FIG. 5) may be adapted to engage the flanges 19 of the first and second slave pistons 16 and 18. A valve seating device 60 may be disposed between the yoke 50 and the housing 12. The valve seating device 60 may comprise any mechanical (e.g., spring), hydraulic, electromechanical, magnetic, pneumatic, or other device capable of slowing the engine valves as they approach their seats.

The yoke 50 may provide a means for activating the valve seating device 60 responsive to the upward translation of the first and second slave pistons 16 and 18. The valve seating device 60 may extend upward from the yoke 50 (as shown), or downward from the housing 12 (not shown). In either case, the valve seating device 60 is disposed between the yoke 50 and the housing 12. As the slave pistons 16 and 18 travel upward and the engine valves 40 approach their seats, the yoke 50 travels upward as well so that the valve seating device 60 engages the housing 12 and opposes the upward movement of the slave pistons. The opposition to the upward movement of the slave pistons may cause the engine valves 40 to seat more gently than they otherwise would.

Figure 4:
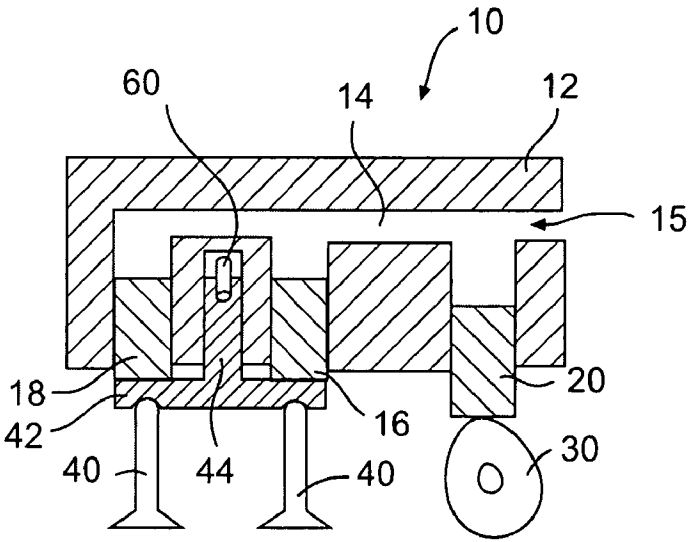
FIG. 4 is a schematic diagram of a valve actuation system constructed in accordance with a fourth embodiment of the present invention.

A fourth embodiment of the present invention is shown in FIG. 4, in which like reference characters refer to like elements. The valve actuation system 10 shown in FIG. 4 differs from that shown in FIG. 1 in that it includes a valve bridge guide portion 44 extending upward from the valve bridge 42 into a guide bore in the housing 12. The guide portion 44 may assist in guiding the vertical translation of the valve bridge 42 so that the actuation of the engine valves is balanced. A valve seating device 60 may be provided between the upper end of the guide portion 44 and the end of the guide bore. As the engine valves 40 translate upward towards their seats, the valve bridge 42 and guide portion 44 translate upward as well. As the engine valves approach their seats, the valve seating device 60 increases the hydraulic pressure in the guide bore so that the valve bridge 42 opposes the closing motion of the engine valves and seats the engine valves as desired.

The valve actuation systems 10 shown in FIGS. 1-4 may actuate intake, exhaust, or auxiliary engine valves 40 to produce a variety of different engine valve events, such as, but not limited to, exhaust gas recirculation, main intake, main exhaust, compression release braking, and/or bleeder braking. The valve actuation system 10 may be switched between modes of transferring motion to the engine valves and not transferring motion responsive to the supply and release of hydraulic fluid to the hydraulic passage 14. Methods and apparatus for controlling the supply and release of hydraulic fluid to a valve actuation system 10 such as shown in FIGS. 1-4 are known. Examples of such methods and apparatus are disclosed in U.S. Pat. No. 6,647,954 to Yang, et al., U.S. Pat. No. 6,550,433 to Vorih, et al., U.S. Pat. No. 6,510,824 to Vorih, et al., U.S. Pat. No. 6,415,752 to Janak, U.S. Pat. No. 6,321,701 to Vorih et al., and U.S. Pat. No. 6,257,183 to Vorih et al., each of which is hereby incorporated by reference in their entirety.

Furthermore, with respect to the various embodiments of the invention described herein, it is appreciated that the motion imparting means 30 may comprise any combination of cam(s), push tube(s), and/or rocker arm(s), or their equivalents, adapted to impart motion to the master piston 20 in the valve actuation system 10. It is also appreciated that in alternative embodiments of the present invention, the valve actuation system 10 may comprise any structure adapted to hydraulically connect the motion imparting means 30 to the engine valves 40 and which includes two or more slave pistons that act on the engine valve or valves of the same engine cylinder or different engine cylinders.

It is also appreciated that the valve actuation system 10 may be operatively connected to any means for supplying hydraulic fluid to and from the system. The supply means may include means for adjusting the pressure of, or the amount of, fluid in the circuit, such as, for example, trigger valve(s), control valve(s), accumulator(s), check valve(s), fluid supply source(s), and/or other devices used to release hydraulic fluid from a circuit, add hydraulic fluid to a circuit or control the flow of fluid in a circuit. Furthermore, the valve actuation system 10 may be used with any internal combustion engine. For example, the valve actuation system 10 may be used with a diesel engine, a gasoline engine, a duel fuel engine, and/or a natural gas engine.

Each of the embodiments of the invention shown in the figures include only one valve seating device for multiple slave pistons. It is appreciated, however, that in alternative embodiments of the present invention, a valve seating device may be provided for each of a number of slave pistons.

It will be apparent to those of ordinary skill in the art that variations and modifications to the embodiments of present invention described herein may be made without departing from the intended spirit and scope of the appended claims. For example, changes in the shape, size, design, and arrangement of the master piston, slave pistons, valve seating device and other valve actuation components may be made without departing from the intended scope of the appended claims.

What is claimed is:

1. A method of actuating two or more engine valves in an internal combustion engine using a system having a master piston hydraulically linked to two or more slave pistons, comprising the steps of:

imparting a linear motion to the master piston;

imparting a linear motion to the two or more slave pistons responsive to the master piston motion;

actuating the two or more engine valves responsive to the motion of the two or more slave pistons; and seating the two or more engine valves by throttling hydraulic fluid flow past a single point located between the two or more slave pistons and the master piston thereby hydraulically opposing the linear motion of the two or more slave pistons as the engine valves approach valve seats.

* * * * *